US005715860A

United States Patent [19]

Horad

[11] Patent Number: 5,715,860

[45] Date of Patent: Feb. 10, 1998

[54] ADJUSTABLE VALVE FOR CONTROLLING THE AMOUNT OF WATER REFILLING A TOILET BOWL AFTER FLUSHING

[76] Inventor: Sewell D. Horad, 2118 University Blvd., W., Silver Spring, Md. 20902

[21] Appl. No.: 742,505

[22] Filed: Nov. 1, 1996

Related U.S. Application Data

[60] Provisional application No. 60/006,196, Nov. 2, 1995.

[51] Int. Cl.[6] ..... E03D 1/00; F16K 21/18; F16K 31/24

[52] U.S. Cl. ..... 137/441; 4/324; 4/366; 4/415; 137/410; 137/426; 137/436; 251/208

[58] Field of Search ..... 4/324, 415, 366; 137/426, 441, 410, 436; 251/120, 205, 208

[56] References Cited

U.S. PATENT DOCUMENTS

| | | | |
|---|---|---|---|
| 1,787,601 | 1/1931 | Swanberg | 137/441 |
| 3,086,546 | 4/1963 | Brown | 137/436 |
| 3,172,128 | 3/1965 | Ducey | 4/366 |
| 3,744,064 | 7/1973 | Preston | 4/415 |
| 4,145,775 | 3/1979 | Butler | 4/441 |
| 4,429,423 | 2/1984 | Syrenne | 4/415 |
| 4,764,996 | 8/1988 | Pino | 137/441 |
| 4,980,932 | 1/1991 | Stemples | 4/415 |
| 5,452,482 | 9/1995 | Nichols-Roy et al. | 137/441 |
| 5,524,299 | 6/1996 | Dalfino | 4/415 |

*Primary Examiner*—George L. Walton

*Attorney, Agent, or Firm*—Millen, White, Zelano, & Branigan, P.C.

[57] ABSTRACT

An adjustable valve is inserted in a tubular connection extending between an inlet lien and overflow pipe in the flush tank of a flush toilet. By adjusting the rate of flow through the valve, the level of water standing in the toilet is determined.

8 Claims, 2 Drawing Sheets

ADJUSTABLE VALVE FOR CONTROLLING THE AMOUNT OF WATER REFILLING A TOILET BOWL AFTER FLUSHING

RELATED PATENT APPLICATION

U.S. Provisional application Ser. No. 60/006,196, filed Nov. 2, 1995.

FIELD OF THE INVENTION

The present invention relates to an adjustable valve for controlling the amount of water refilling a toilet bowl and, more particularly, to such a valve which adjusts the rate of flow of water refilling the toilet bowl.

BACKGROUND OF THE INVENTION

A concerted effort is now afoot to now conserve fresh potable water. Flush toilets use enormous amounts of water, consuming four to five gallons per flush. A lot of the water consumed is used to fill toilet bowls after flushing. Several quarts of water may be required to fill the bowl and, in many cases, this amount of water is unnecessary. The water level in some toilet bowls is so high that, on occasion, a person using the toilet gets wet when they sit. The present invention allows one to adjust the water level in the bowl to a suitable level which results in extensive water savings.

U.S. Pat. No. 3,086,546 includes an element for adjusting the rate of water flow to an overflow tank but the adjustment is hidden and not readily retrofitted.

SUMMARY OF THE INVENTION

In view of the aforementioned considerations it is a feature of the present invention to provide a new and improved apparatus for adjustably controlling the rate of water flow from a water inlet to an overflow pipe in a flush toilet.

In view of this feature and other features the present invention is directed to a valve which is inserted in a tubular connection between a flush tank inlet line and an overflow pipe. The valve is adjustable from a location outside of the tubular connection.

In a more specific aspect, the valve is a ball valve and, in a still more specific aspect, the valve is mounted in the tank by either a strut connected to the overflow pipe or by a bracket fitted over an upper edge of the flush tank.

Upon further study of the specification and appended claims, further objects and advantages of this invention will become apparent to those skilled in the art.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
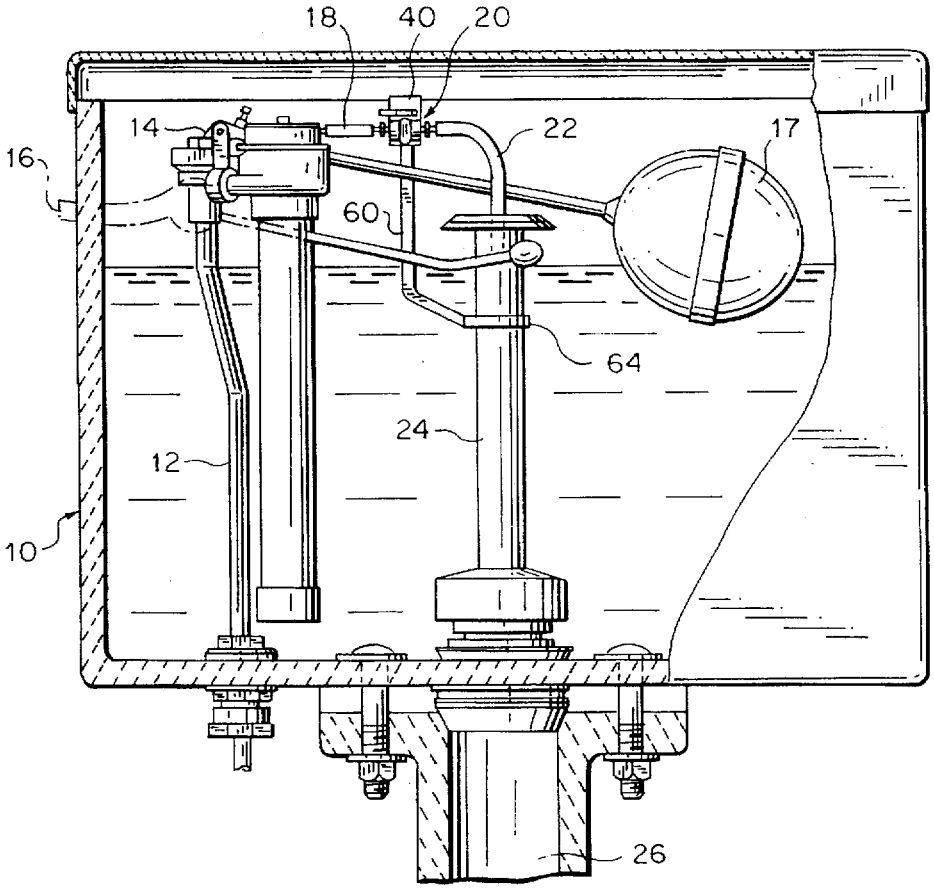
FIG. 1 is a front view, with portions broken away, of a toilet bowl flush tank employing the present invention.

Referring now to FIG. 1, there is shown a conventional flush tank 10 for a toilet bowl (not shown). The flush tank includes a water inlet line 12 and a conventional main valve 14 which is opened by an operating handle 16 and closed by a float 17. The main valve 14 is connected by first a tube 18 to a secondary valve 20 configured in accordance with the principles of the present invention. The secondary valve 20 is connected by a second tube 22 to an overflow pipe 24 that is connected by a passage 26 to the toilet bowl (now shown). If the water level in the tank 10 rises above the top of the overflow pipe 24 due to a malfunction in the valve 14, then the water drains down the overflow pipe 24 and into the toilet bowl where it passes through the drain line of the bowl and into the sewer system.

When the toilet is flushed, it is necessary to replenish water in the toilet bowl as well as the flush tank 10. This is ordinarily accomplished by water from the inlet line 12 flowing through main the valve 14 and the tube 18 directly into the overflow pipe 24. Thus, as the flush tank 10 fills, so does the toilet bowl. By filling the toilet bowl with water, sewer gases are blocked from venting through the toilet bowl into the lavatory or bathroom. Unfortunately, many toilet bowls fill to an unnecessarily high level, thereby wasting water and on occasion soaking portions of the person sitting on the toilet.

The secondary valve 20 of the instant invention prevents this by controlling the rate of water flow into the overflow pipe 24. By reducing the rate of water flow into the overflow pipe 24, the amount of water which can flow into the overflow pipe before the float 17 terminates the flow of water into the inlet tube 12 can be reduced substantially. This is because the reduced flow rate multiplied by time results in less water volume.

The secondary valve 20 is preferably a ball valve in which a spherical valve element 28 having a passage 29 rotated by an operator such as a handle 30 to align the passage 29 with inlet passage 31*a* and outlet passage 31*b* which are axially aligned in the valve body 32. The amount of water in the toilet bowl is determined by observing the water level and adjusting the rate of flow through the valve 20 by turning the handle 30.

Figure 2:
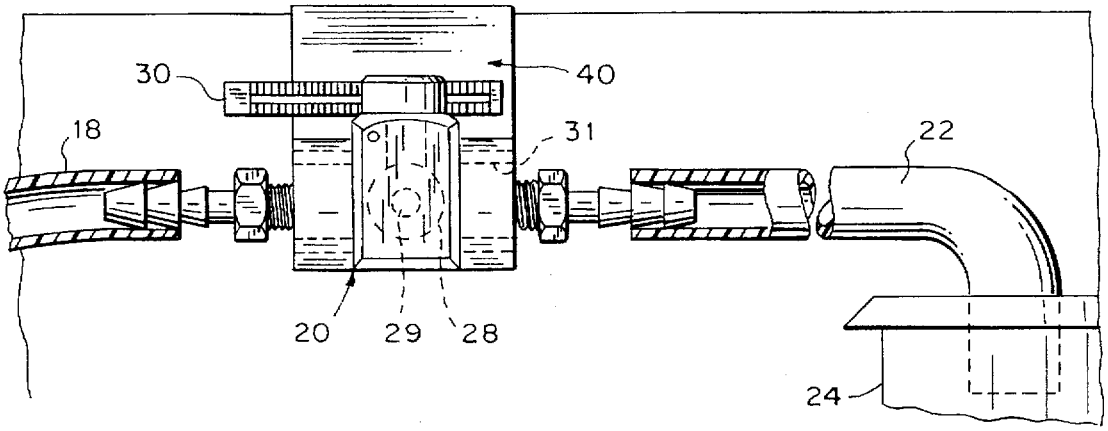
FIG. 2 is an enlarged view of a valve and associated mounting bracket configured in accordance with the principles of the present invention.
Figure 3:
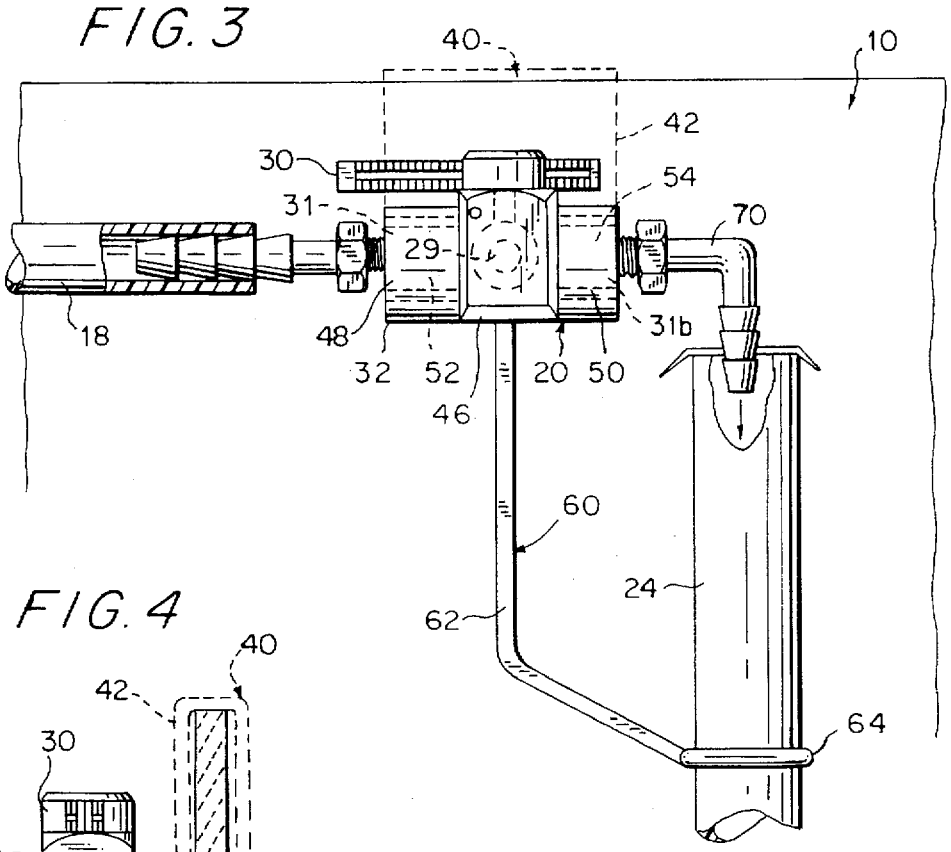
FIG. 3 is a view of a second embodiment of a valve of the present invention.
Figure 4:
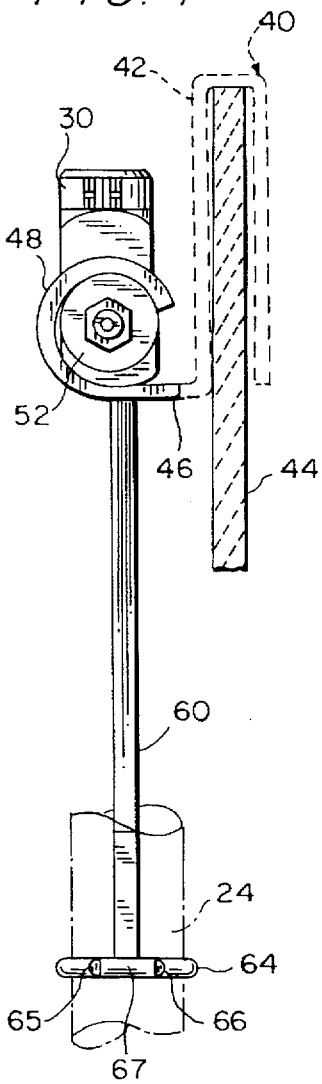
FIG. 4 is an end view of the valve of FIGS. 1–3.

The valve 20 may be supported in the tank 10 by a bracket 40 shown in solid lines in FIGS. 1 and 2 and dotted lines in FIGS. 3 and 4 which has a U-shaped support 42 that fits over the top of the tank wall 44 and a shelf 46 having a pair of arcuate retainers 48 and 50 that are fit around barrel portions 52 and 54 of the valve 20. The bracket 40 is preferably made of a flexible plastic material so that the circular retainers 48 and 50 can be bent or deflected to easily position the valve 20 therein.

An alternative approach to the bracket 40 is a strut support 60. The strut support 60 comprises a strut 62 which has a resilient clamp 64 at a first end thereof which clamps around the overflow pipe 24, as is seen in FIG. 4. Note in FIG. 4 that there are two ends 65 and 66 separated by a space 67. Since the clamp 64 is resilient, it is spread to receive the pipe 24 and released to resiliently clamp therearound. At the top or second end of the strut 60, a support plate 46 similar to the support plate that is used with the bracket 40. When using the strut support 60, the U-shaped retainer 42 is no longer needed. The clamp 64 is adjustable on the overflow pipe 24 so that it can be raised and lowered within the flush tank 10 to accommodate flush tanks of different heights. Accordingly, the position of the secondary valve 20 is variable within the flush tank 10.

In the embodiment of FIG. 3, the outlet is an elbow tube 70 that dispenses directly into the overflow pipe 24. Accordingly, there is no need for no additional tubing such as the tube 22.

Figure 5:
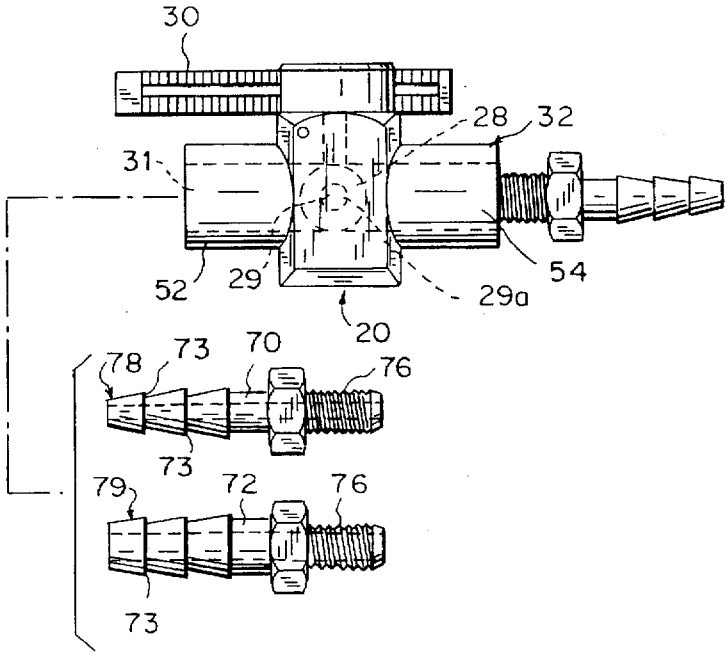
FIG. 5 is a side view of the valve showing alternative screw-in nipples.

Referring now to FIG. 5, it is seen that the valve 20 can be furnished with alternative inlet nipples 70 and 72 each of which has a projecting end with annular barbs 73 which retain tubes 18 of various sizes on the valve 14 (see FIGS. 1, 2 and 3). The threaded ends 76 of the nipples 70 and 72 which are threaded into the body of the valve 20 have the same diameter, but the projecting ends 78 and 79 are of differing diameters so as to accommodate tubes 18 of different diameters.

The aforedescribed configuration for the valve assembly provides a easily installed convenient device for controlling the level of water in a toilet bowl.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An valve apparatus used in a flush toilet for controlling flow of water from a water inlet line through the valve apparatus and into a flush tank, wherein the water inlet line is connected to a main valve which controls water flow to refill the flush tank through a main valve outlet, while simultaneously diverting water to an overflow pipe, the overflow pipe being connected to a toilet bowl for filling the toilet bowl as water in the overflow pipe is replenished, the apparatus comprising:

a first tube extending from the main valve outlet;

a secondary valve connected to the first tube for selectively controlling the rate of water flow through the first tube by controlling the size of an opening through the secondary valve;

a second tube extending from the secondary valve to the overflow pipe;

an operator connected to the secondary valve, the operator being accessible from outside of the secondary valve for controlling the size of the opening through the secondary valve to thereby control the rate of water flow through the second tube to the overflow pipe and to the toilet bowl so as to control the level of water in the toilet bowl at the time the water inlet is shut off by the main valve; and a removable support for the valve, wherein the support is a strut which has a first end and a second end, the first end being clamped to the overflow pipe and the second end being fixed to the secondary valve for holding the secondary valve at a position above the overflow pipe, wherein said support is variably adjustable along the overflow pipe so as to accomodate flush tanks of different heights.

2. The apparatus of claim 1, wherein the secondary valve is ball valve and includes a spherical valve element with an opening therethrough formed about an axis, the valve element being turned by the operator to align the axis of the opening with axially aligned inlet and outlet passages in the valve element.

3. The apparatus of claim 2 further including a mounting bracket having a U-shaped support at one end which fits over the top rim of the flush tank and a coupling that is connected to the valve to support the valve in the tank at a position above the inlet of the overflow pipe.

4. The apparatus of claim 3, wherein the secondary coupling is an arcuate retainer which fits around the valve.

5. The apparatus of claim 2 further including at least a pair of nipples, each having a first end of the same size for connecting to the inlet passage of the secondary valve and each having a second end of a different diameter for coupling with different diameter tube extending from the inlet line.

6. The apparatus of claim 5, wherein the first ends of the nipples are threaded.

7. The apparatus of claim 1 further including a rigid L-shaped outlet nipple for connecting the valve outlet passages directly to the open end of the overflow pipe.

8. The apparatus of claim 7, wherein the secondary second end of the strut includes an arcuate retainer which fits around the valve.

* * * * *